US006201503B1

(12) United States Patent
Oshiyama

(10) Patent No.: US 6,201,503 B1
(45) Date of Patent: Mar. 13, 2001

(54) ANTENNA FOR RADIO DEVICE AND RADIO DEVICE

(75) Inventor: Tadashi Oshiyama, Tomioka (JP)

(73) Assignee: Kabushiki Kaisha Yokowo, Tokyo-to (JP)

( * ) Notice: Subject to any disclaimer, the term of this patent is extended or adjusted under 35 U.S.C. 154(b) by 0 days.

(21) Appl. No.: 09/469,626

(22) Filed: Dec. 22, 1999

(51) Int. Cl.[7] ..... H01Q 1/24
(52) U.S. Cl. ..... 343/702; 343/803; 343/895
(58) Field of Search ..... 343/702, 803, 343/806, 895, 901, 903, 906

(56) References Cited

U.S. PATENT DOCUMENTS 6,031,496 * 2/2000 Kuittinen et al. ..... 343/702
6,130,651 * 10/2000 Yanagisawa et al. ..... 343/702

* cited by examiner

*Primary Examiner*—Tan Ho
(74) *Attorney, Agent, or Firm*—Dickstein Shapiro Morin & Oshinsky LLP

(57) ABSTRACT

Conductive tongues project from two places on the axial direction tip of a first antenna element, which projects outwardly from the case of a radio device. When a second antenna element, freely movable in the axial direction, is extracted, the two conductive tongues conductively connect to the base of the second antenna element, and are mutually short-circuited.

10 Claims, 13 Drawing Sheets

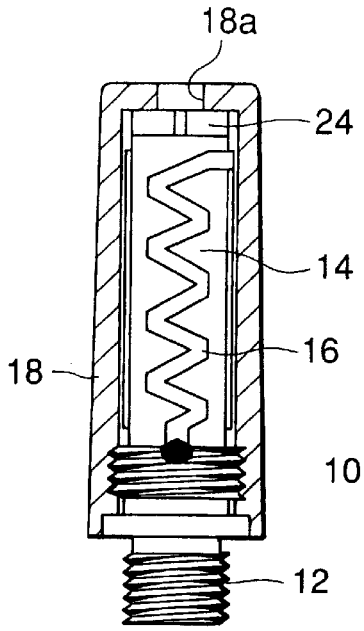
FIG.4
FIG.5(a)
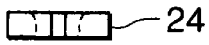
FIG.5(b)
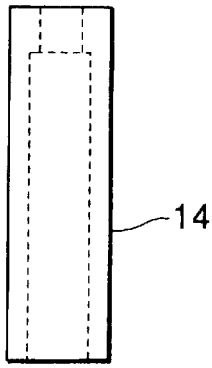
FIG.5(c)
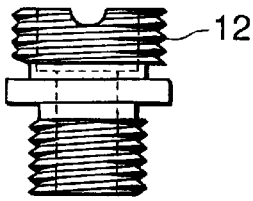
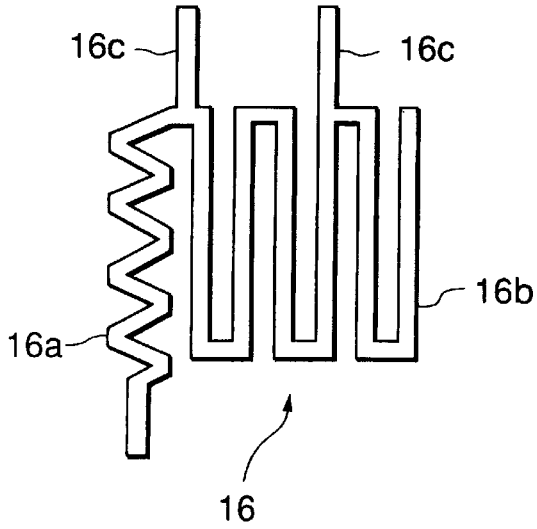
FIG.5(d)

ANTENNA FOR RADIO DEVICE AND RADIO DEVICE

BACKGROUND OF THE INVENTION

1. Field of the Invention

The present invention relates to an antenna for radio device projecting outwardly from the case of a mobile telephone or the like, and a radio device using the antenna.

2. Description of the Related Art

In order to receive call-up signals, a mobile telephone and the like needs an antenna device which operates as an antenna at all times. On the other hand, it is not desirable for a long antenna to be projecting from the case at all times, since it renders the telephone less easily portable. Accordingly, various types of antenna devices have been proposed in which call-up signals are received by an antenna element having a relatively short physical length and projecting outwardly from the case at all times, a longer rod-like antenna element being extracted during communication to achieve high-gain reception and transmission. The present applicants have already disclosed an example of such an antenna device in Japan Patent Application 1996-266656.

The technology proposed in Japan Patent Application 1996-266656 will be explained simply with reference to FIG. 14 and FIG. 15. FIG. 14 is a circuit diagram showing the antenna for radio device described above in an extracted state. FIG. 15 is a vertical cross-sectional view of the extracted antenna for radio device shown in FIG. 14.

In FIG. 15, a mounting metal part 12 comprises a conductive metal and is securely screwed to a case 10 of a radio device. A through hole 12*a* is provided in the mounting metal part 12. In addition, a substantially cylindrical core 14 of insulating resin is provided coaxially to the mounting metal part 12 and extends outwardly therefrom. A first antenna element 16 is wrapped around the outer face of the core 14 so as to be substantially cylindrical. Furthermore, a cover 18 comprising insulating resin covers the first antenna element 16, and the bottom end of the cover 18 is secured to the mounting metal part 12. A hole 18*a* is coaxially provided in the cover 18, and a ring groove for clipping 18*b* is provided in the inner wall of the hole 18*a*.

The through hole 12*a* of the mounting metal part 12, the substantially cylindrical core 14, and the hole 18*a* of the cover 18 are provided around a single axis. Furthermore, a rod-like second antenna element 22 has a rod-like insulating member 20 on its tip, and is provided so as to be capable of moving freely in the same axial direction as the above. The outer face and base and the like of the second antenna element 22 are all covered by an insulating tube or the like. Furthermore, an axis-encircling groove for clipping 20*a* is provided in the tip of the rod-like insulating member 20, and a button 20*b* for restricting the movement of the second antenna element 22 in the storage direction is provided on the tip thereof. Furthermore, an axis-encircling groove for clipping 22*a* is provided in the insulator covering the base portion of the second antenna element 22. A step 22*b* is provided at the bottom of the second antenna element 22 to restrict its movement in the extraction direction. Furthermore, a ring for clipping 24 comprises a ring-shaped insulating resin having a cutaway portion, and is inserted into the ring groove for clipping 18*b* in the cover 18. When the antenna is stored, the ring for clipping 24 meshes with the groove for clipping 20*a* of the rod-like insulating member 20, thereby holding the antenna in the stored state. When the antenna is extracted, the ring for clipping 24 meshes with the groove for clipping 22*a* in the second antenna element 22, thereby holding the antenna in the extracted state.

As shown in FIG. 14, the first antenna element 16 comprises a zigzag portion 16*a* extending in the axial direction, and a folded portion 16*b* extending in the peripheral direction. The first antenna element 16 is wound cylindrically around the core 14, and the base of the folded portion 16*a* is conductively connected to the mounting metal part 12 by soldering.

A feeding metal part 26 comprises a conductive metal, and engages with the mounting metal part 12 screwed to the case 10. Further, the feeding metal part 26 is conductively connected via a cable 28 to an antenna input/output terminal 29 of a radio circuit 29.

According to the above constitution, when the antenna is extracted as shown in FIG. 14, the axial direction tip of the first antenna element 16 is connected at high frequency to the base of the second antenna element 22 by the coupling of a floating capacitance Ci, whereby the first and second antenna elements 16 and 22 function as a single antenna. Furthermore, when the antenna is stored (the diagram does not show this state), the second antenna element 22 is inside the case 10 and consequently is not connected at high frequency to the first antenna element 16, whereby only the first antenna element 16 functions as an antenna.

Accordingly, the antenna can be stored when the mobile telephone or the like is being carried, and is able to receive call-up signals using only the first antenna element 16. On the other hand, during communication, the second antenna element 22 is extracted, whereby the first and second antenna elements 16 and 22 enable the antenna to receive and transmit with high gain.

The previously proposed antenna for radio device described above is conveniently portable, and has high antenna gain during communication. However, when the second antenna element 22 is extracted, its base is coupled to the axial direction tip of the first antenna element 16 by the floating capacitance Ci, and this floating capacitance Ci is not always constant. During manufacturing, adjustment of the band of resonant frequencies at which the first and second antenna elements 16 and 22 function as a single antenna is complex.

Furthermore, when the second antenna element 22 is extracted, its base is capacitance-coupled to multiple axial direction tip portions of the folded portion 16*b* which extends in the peripheral direction of the first antenna element 16. Multiple closed loops are formed by the floating capacitances between these axial direction tip portions, and the partial impedance of the folded portion 16*b*. These multiple closed loops have a detrimental effect of lowering the antenna gain. There is a further problem, in that the resonant frequencies of the closed loops are not constant.

SUMMARY OF THE INVENTION

The present invention has been devised in order to solve the problems of the previously proposed antenna for radio device, and aims to provide an antenna for radio device and a radio device using the antenna wherein, when the base of the extracted second antenna element is conductively connected to the axial direction tip of the first antenna element, antenna characteristics are stable and antenna gain is high.

In order to achieve the above objects, the antenna for radio device of the present invention comprises a mounting metal part having a through hole therein and being attached to a case of a radio device; a first antenna element provided to this mounting metal part cylindrically around the same axis as the through hole and projecting to the outside of the case; conductive tongues projecting from a plurality of places on the first antenna element; a rod-like second antenna element having a rod-like insulating member at its tip portion, capable of moving freely in the axial direction of the through hole and the cylindrical first antenna element; the plurality of conductive tongues conductively connecting to a base portion of the second antenna element, and to each other, when the second antenna element is extracted, and the plurality of conductive tongues clasping either side of the rod-like insulating member and connecting nonconductively to each other when the second antenna element is stored.

In an alternative arrangement of the present invention, the first antenna element may comprise a zigzag portion or a folded portion extending in the axial direction, and a zigzag portion or a folded portion connected at an axial direction tip portion thereof and extending in the peripheral direction of the cylinder.

Alternatively, the conductive tongues may project from multiple places comprising an axial direction tip portion of a zigzag portion or a folded portion extending in the axial direction, and a middle portion of axial direction tip portion of a zigzag portion or a folded portion extending in the peripheral direction of the cylinder.

Alternatively, the first antenna element may comprise a linear portion extending in the axial direction, and a zigzag portion or a folded portion extending in the peripheral direction of the cylinder and connected at the axial direction tip thereof.

Furthermore, the conductive tongues may project from multiple places comprising an axial direction tip portion of a linear portion extending in the axial direction, and a middle portion of a zigzag portion or a folded portion extending in a peripheral direction of the cylinder and connected at the axial direction tip thereof.

In yet another alternative arrangement of the present invention, axis-encircling grooves for clipping are provided in the tip of the rod-like insulating member and the base of the second antenna element, the plurality of conductive tongues elastically changing shape and fitting into the grooves for clipping, and at least the surface of the groove for clipping in the base of the second antenna element being a conductor conductively connecting to the base of the second antenna element.

Furthermore, a ring for clipping, which elastically changes shape in the direction of its diameter, may be provided to the multiple conductive tongues, so that the elasticity of the ring for clipping fits the conductive tongues into the groove for clipping.

Furthermore, the antenna for radio device of the present invention may comprise a mounting metal part having a through hole therein and being attached to a case of a radio device; a first antenna element provided to this mounting metal part cylindrically around the same axis as the through hole and projecting to the outside of the case; conductive tongues projecting from the first antenna element; a rod-like second antenna element having a rod-like insulating member at its tip portion, capable of moving freely in the axial direction of the through hole and the cylindrical first antenna element; the plurality of conductive tongues conductively connecting to a base portion of the second antenna element when the second antenna element is extracted, and the conductive tongues clasping either side of the rod-like insulating member when the second antenna element is stored.

Furthermore, the radio device of the present invention radio device uses the antenna for radio device described above, the mounting metal part comprising a conductive metal, the base of the first antenna element being secured and conductively connected to the mounting metal piece, and the mounting metal piece being conductively connected to an antenna input/output terminal of a radio circuit.

BRIEF DESCRIPTION OF THE DRAWINGS

FIG. 4 is a front view when the cover is removed of a structure comprising the mounting metal part, the core, the first antenna element, the ring for clipping, and the cover shown in FIG. 2;

FIGS. 5(*a*) to 5(*d*) show the members assembled in FIG. 4, FIG. 5(*a*) being a front view of the ring for clipping, FIG. 5(*b*) being a front view of the core, FIG. 5(*c*) being a front view of the mounting metal part, and FIG. 5(*d*) being an expanded view of the first antenna element;

DESCRIPTION OF THE PREFERRED EMBODIMENTS

Figure 1A:
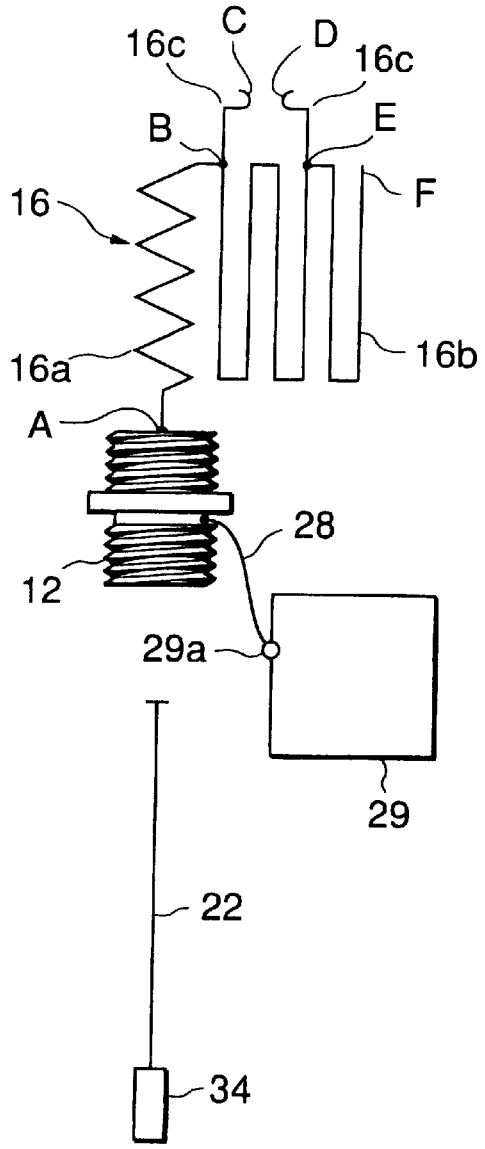
FIGS. 1(*a*) and 1(*b*) are circuit diagrams showing an embodiment of the antenna for radio device and the radio device of the present invention, FIG. 1(*a*) showing a stored state, and FIG. 1(*b*), an extracted state.
Figure 1B:
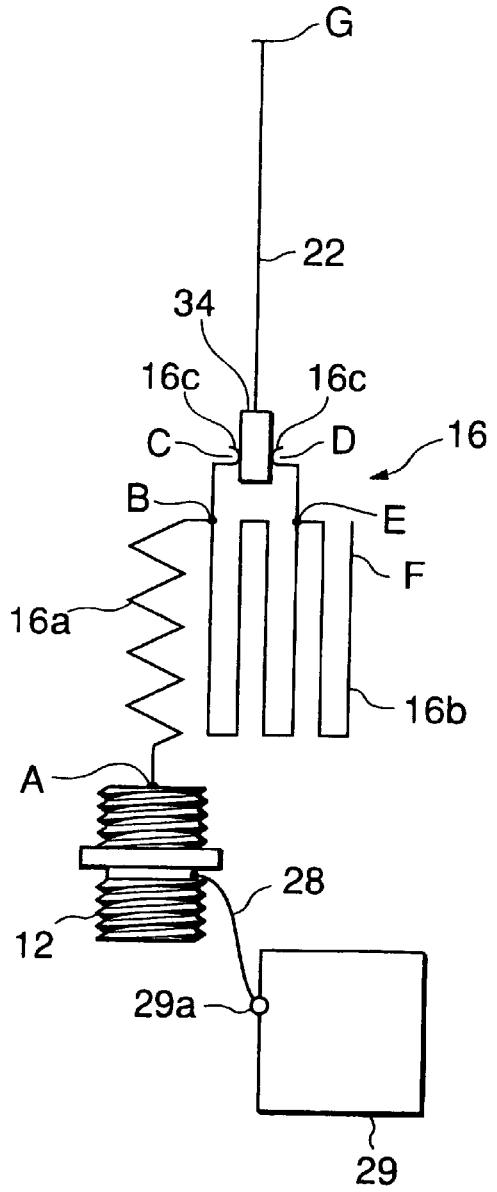
Figure 2A:
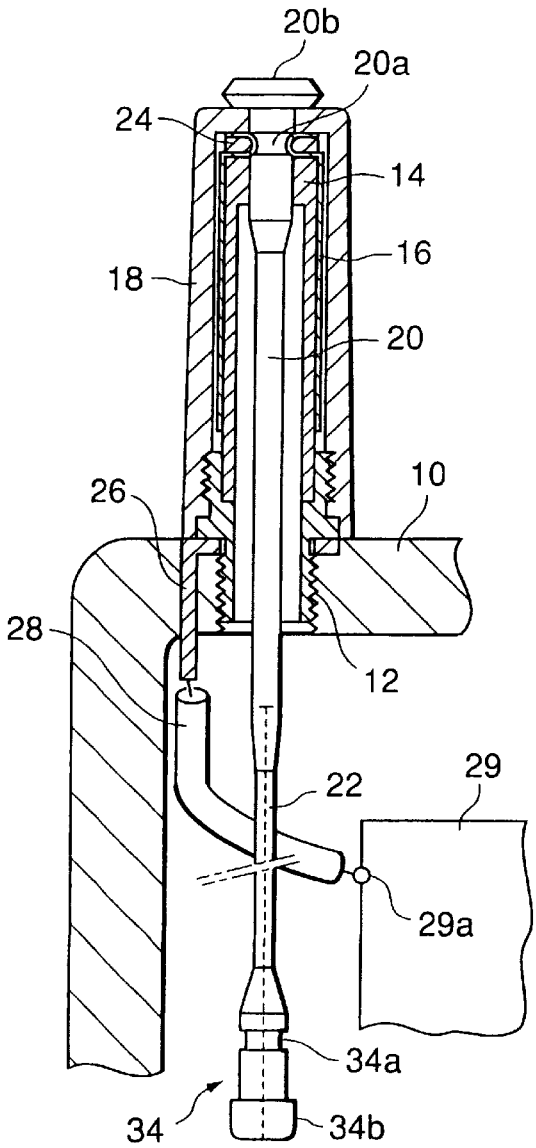
FIGS. 2(*a*) and 2(*b*) are vertical cross-sectional views of the antenna for radio device shown in FIG. 1, FIG. 2(*a*) showing the stored state, and FIG. 2(*b*), the extracted state.
Figure 2B:
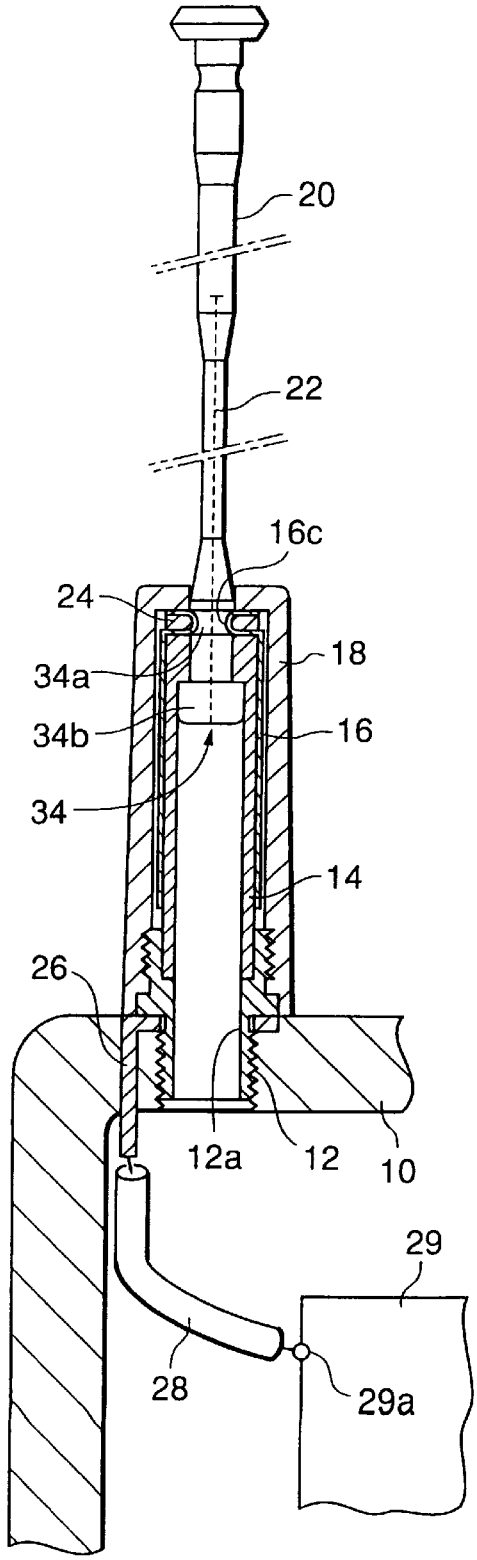
Figure 3:
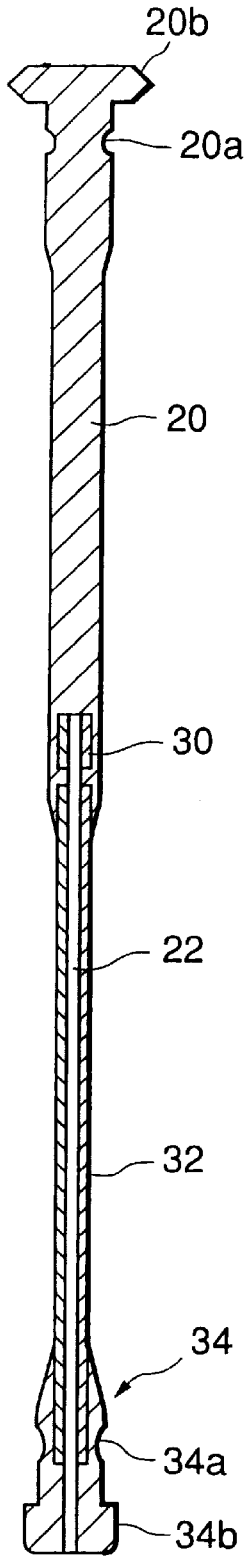
FIG. 3 is a vertical cross-sectional view of a rod-like second antenna element having a rod-like insulating member on the tip side thereof shown in FIG. 2.
Figure 6A:
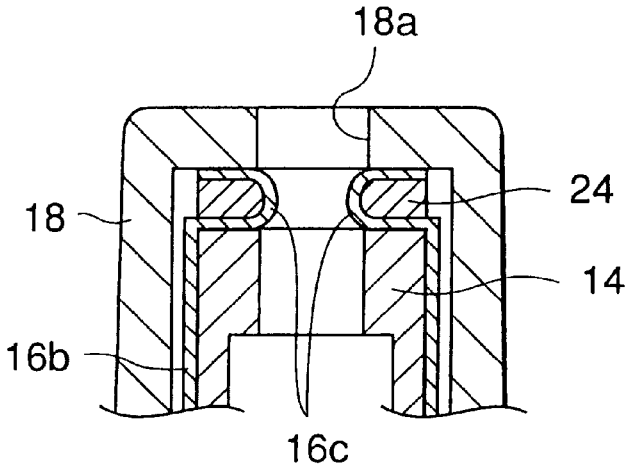
FIGS. 6(*a*) and 6(*b*) show constitutions in which a ring for clipping is attached to the conductive tongues provided on the first antenna element, FIG. 6(*a*) being a vertical cross-sectional view of the assembled structure, and FIG. 6(*b*) being a plan view of the ring for clipping when the conductive tongues are attached thereto.
Figure 6B:
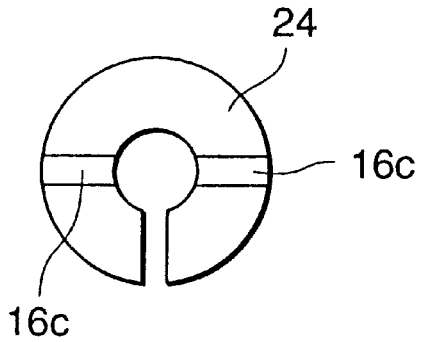
Figure 14:
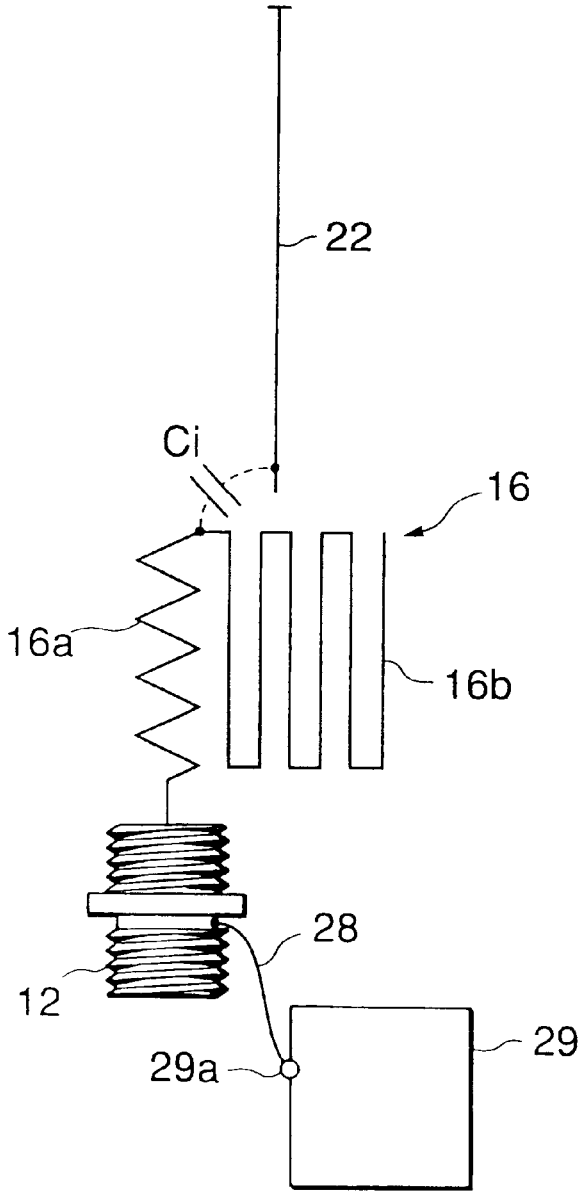
FIG.14 PRIOR ART
FIG. 14 is a circuit diagram showing the extracted state of an antenna for radio device and an antenna of a radio device which were proposed previously.
Figure 15:
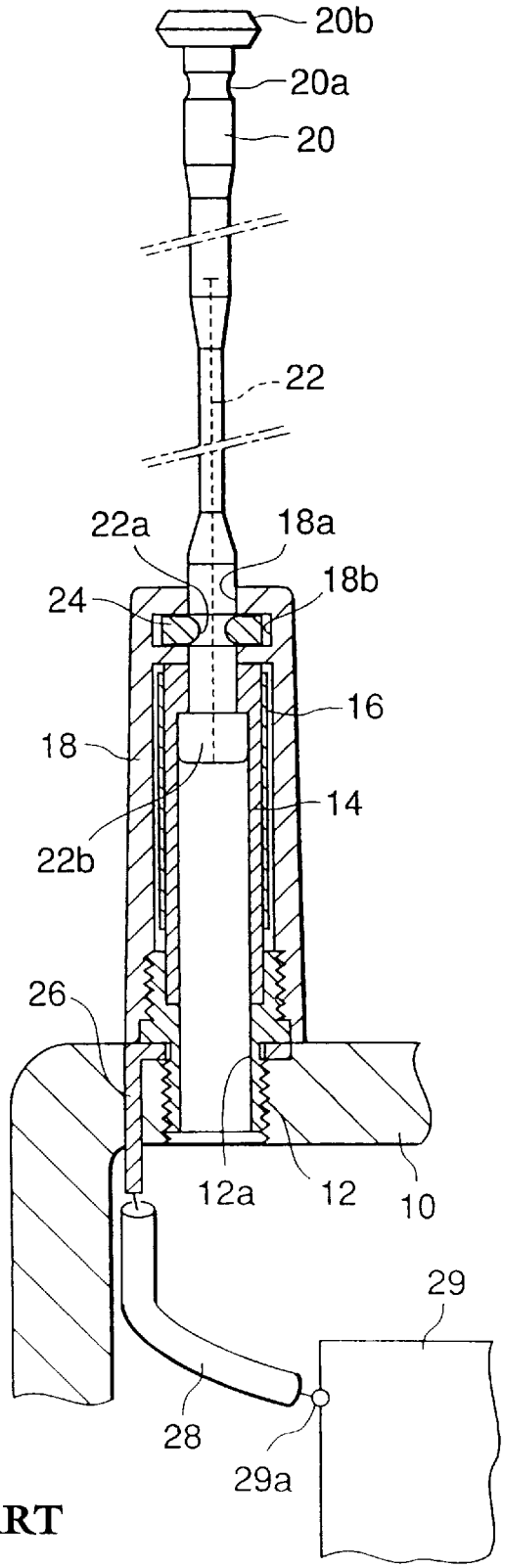
PRIOR ART FIG.15
FIG. 15 is a vertical cross-sectional view of the antenna for radio device shown in FIG. 14 in an extracted state.

Preferred embodiments of the present invention will be explained with reference to FIGS. 1 to 6. FIGS. 1(*a*) and 1(*b*)

are circuit diagrams showing an embodiment of the antenna for radio device and the radio device of the present invention, FIG. 1(*a*) showing a stored state, and FIG. 1(*b*), an extracted state. FIGS. 2(*a*) and 2(*b*) are vertical cross-sectional views of the antenna for radio device shown in FIG. 1, FIG. 2(*a*) showing the stored state, and FIG. 2(*b*), the extracted state. FIG. 3 is a vertical cross-sectional view of the rod-like second antenna element having a rod-like insulating member on the tip side thereof shown in FIG. 2. FIG. 4 is a front view of an assembled structure comprising the mounting metal part, the core, the first antenna element, the ring for clipping, and the cover shown in FIG. 2, when the cover is removed. FIGS. 5(*a*) to 5(*d*) show the members assembled in FIG. 4, FIG. 5(*a*) being a front view of the ring for clipping, FIG. 5(*b*) being a front view of the core, FIG. 5(*c*) being a front view of the mounting metal part, and FIG. 5(*d*) being an expanded view of the first antenna element. FIGS. 6(*a*) and 6(*b*) show how the conductive tongues of the first antenna element are attached to the ring for clipping, FIG. 6(*a*) showing a vertical cross-sectional view of the assembled structure, and FIG. 6(*b*) showing a plan view of the ring for clipping when the conductive tongues have been attached. In FIGS. 1 to 6, same or like members to those shown in FIGS. 14 and 15 are represented by the same reference symbols, and further explanation thereof is omitted.

There follows an explanation of points of difference between the antenna for radio device of the present invention and the antenna for radio device proposed previously.

Firstly, as shown in FIG. 5(*d*), the first antenna element 16 comprises a zigzag portion 16*a* extending in the axial direction, and a folded portion 16*b* extending in the peripheral direction. In addition, a conductive tongue 16*c* is provided at the join between the zigzag portion 16*a* and the folded portion 16*b*, and projects upward from the tip portion in the axial direction toward the tip of the first antenna element 16. Furthermore, another conductive tongue 16*c* is provided at the midpoint of the folded portion 16*b*, and similarly projects upward from the tip portion in the axial direction toward the tip of the first antenna element 16. Then, as shown in FIGS. 6(*a*) and 6(*b*), the ring for clipping 24 is inserted between the top of the core 14 and the cover 18, and the conductive tongues 16*c* and 16*c* fit along the wall of the inner rim of the ring for clipping 24. To enable the shapes of the conductive tongues 16*c* and 16*c* to flexibly change shape in correspondence with the flexible change in the shape of the ring for clipping 24 along its diameter, the first antenna element 16 comprises a good conductor which also has excellent elasticity, such as, for example, an adjacent@ bronze plate.

Furthermore, the second antenna element 22 comprises a flexible conductor. A metal part 30 is secured by caulking to the tip thereof, an insulating tube 32 covers the middle, and a stopper 34 comprising a conductive metal is secured by caulking to the base. Here, the base of the second antenna element 22 is electrically connected to the stopper 34. Furthermore, an axis-encircling groove for clipping 34*a* is provided in the stopper 34. A step 34*b* is provided at the base of the groove for clipping 34*a*, and restricts movement in the extraction direction. Then, the second antenna element 22 is inserted, and the rod-like insulating member 20 is attached to the tip side thereof by an insulating resin. An axis-encircling groove for clipping 20*a* is provided at the tip portion of the rod-like insulating member 20, and a knob 20*b* for restricting the movement of the second antenna element 22 in the storage direction is provided at the tip thereof.

In the constitution described above, the second antenna element 22 is not connected at high frequency to the first antenna element 16 while in the stored state, so that only the first antenna element 16 functions as an antenna and receives call-up signals. Here, as shown in FIG. 1(*a*), the first antenna element 16 acts as an A-B-E-F antenna. Accordingly, the frequency band of call-up signals aiming to receive the effective length of this antenna should be set to one-quarter, three-eighths, one-half, and the like, of the wavelength.

Furthermore, when the second antenna element 22 is extracted, the two conductive tongues 16*c* and 16*c* both fit elastically into the groove for clipping 34*a* in the stopper 34 at the base of the second antenna element 22, and are conductively connected thereto. Accordingly, as shown in FIG. 1(*b*), A-B-C-G functions as a single antenna comprising the first and second antenna elements 16 and 22. Here, the two conductive tongues 16*c* and 16*c* are conductively connected and short-circuited by the stopper 34. Consequently, the portion of the first antenna element 16 from B to E does not function as an antenna. Furthermore, the portion of the first antenna element 16 from E to F has a short antenna effective length, and resonates at a frequency much higher than the frequencies used for call-up and communication. Consequently, it does not adversely affect on the band of used frequencies. Accordingly, the effective length of the antenna comprising A-B-C-G should be set to one-quarter, three-eighths, one-half, and the like, of the wavelength of the used frequency band.

Moreover, by short-circuiting the portion of the first antenna element 16 from B to E so that it does not function as an antenna, and conductively connecting the base of the second antenna element 22 to the point B of the first antenna element 16, the length of extraction required is greater than when the base of the second antenna element 22 is conductively connected to the point F or the like of the first antenna element 16. Accordingly, when the antenna is to be used near the head of a person, such as in a mobile telephone, the antenna can be positioned higher than the head of the user by extracting it to a greater length as mentioned in the above embodiment, thereby reducing the effect of the user's body on the antenna characteristics by a corresponding amount. Furthermore, when the base of the second antenna element 22 is conductively connected to the point B on the tip portion in the axial direction of the first antenna element 16, instead of to the point A, the storage length of the second antenna element 22 can be further reduced by a length corresponding to the length of A to B.

However, when the second antenna element 22 is being stored, the conductive tongues 16*c* and 16*c* projecting from two places on the first antenna element 16 are, for example, opposite each other on the inner wall of the ring for clipping 24, creating a floating capacitance therebetween. Accordingly, this floating capacitance forms a closed loop with the inductance between B to F of the folded portion 16*b* of the first antenna element 16, from which the conductive tongues 16*c* and 16*c* are projecting. This closed loop lowers the gain of the antenna. Therefore, in order to prevent a reduction in the gain of the antenna while the second antenna element 22 is being stored, it is preferable to reduce the value of the floating capacitance between the conductive tongues 16*c* and 16*c*, and also to reduce the value of the inductance between B and F of the first antenna element 16. In addition, when the second antenna element 22 is extracted, the inductance between E and F of the folded portion 16*b* of the first antenna element 16 should preferably be small. For various reasons, in the present embodiment, one of the conductive tongues 16*c* is provided as appropriate at a central portion E of the folded portion 16*b* of the first antenna element 16. Nevertheless, it is not necessary for one of the conductive tongues 16*c* to be provided in the center portion of the folded portion 16*b*. Instead, it may be provided at the termination F.

Figure 7A:
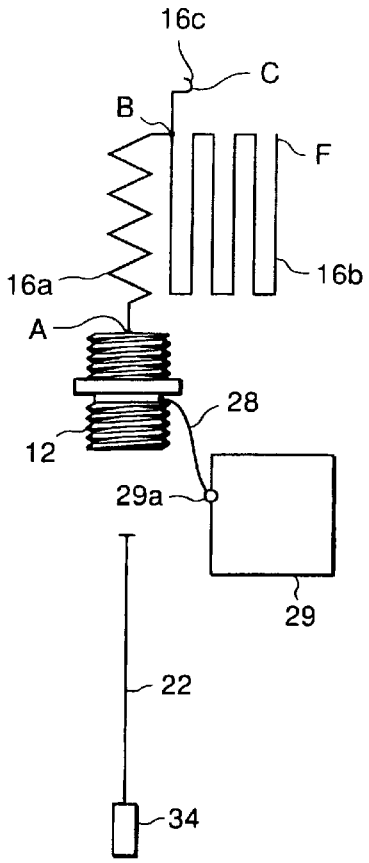
FIGS. 7(*a*) and 7(*b*) are circuit diagrams of another embodiment of an antenna for radio device and a radio device of the present invention, FIG. 7(*a*) showing a stored state, and FIG. 7(*b*) showing an extracted state.
Figure 7B:
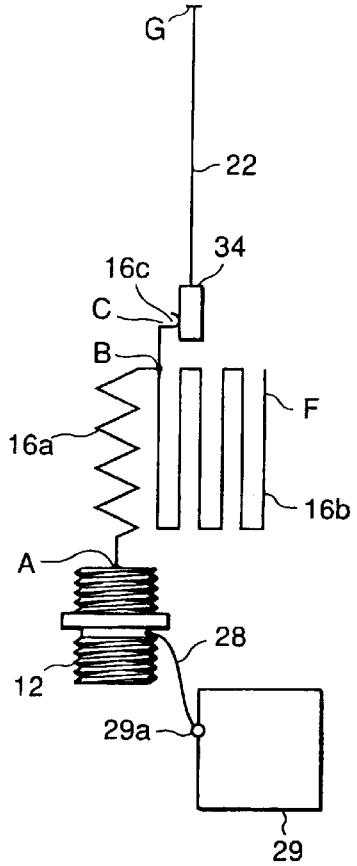
Figure 8:
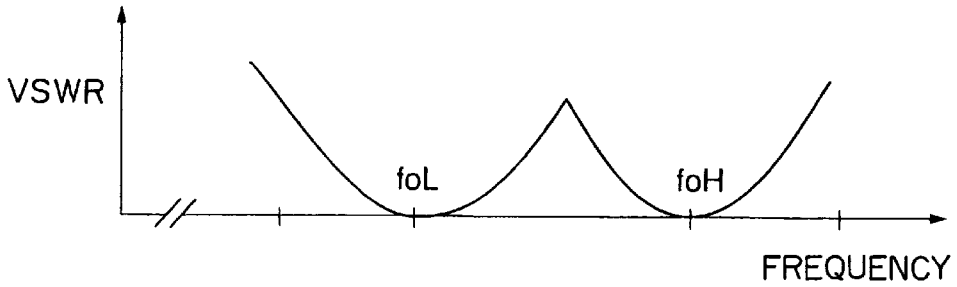
FIG. 8 is a diagram showing an example of antenna characteristics V, S, W, R, when the antenna for radio device is in the extracted state.

Next, another embodiment of the present invention will be explained with reference to FIGS. 7(*a*), 7(*b*), and 8. FIGS. 7(*a*) and 7(*b*) are circuit diagrams showing another embodiment of the antenna for radio device and the radio of the present invention, 7(*a*) showing the stored state, and 7(*b*), the extracted state. FIG. 8 is a diagram showing an example of antenna characteristics VSWR when the antenna for radio device of FIG. 7 is extracted. In FIGS. 7(*a*) and 7(*b*), like parts to those shown in the first embodiment are represented by like reference symbols, and no further explanation of these is given.

The other embodiment shown in FIGS. 7(*a*) and 7(*b*) differs from that shown in FIG. 1 in that, although a conductive tongue 16*c* is provided from the tip portion in the axial direction at the join of the folded portion 16*b* extending in a peripheral direction to the zigzag portion 16*a*, which extends in the axial direction of the first antenna element 16, no other conductive tongue is provided. When the second antenna element 22 is extended, as shown in FIG. 7(*b*), the single conductive tongue 16*c* conductively connects to the base thereof as in the first embodiment.

With this constitution, when the second antenna element 22 is stored, as shown in FIG. 7(*a*), only the first antenna element 16 functions as an antenna. Then, when the second antenna element 22 is extracted, as shown in FIG. 7(*b*), the portion comprising A-B-C-G functions as an antenna. Here, the portion A-B-F of the first antenna element 16 has a resonant frequency and functions as an antenna. Furthermore, the portion A-B-C-G comprising the first and second antenna elements 16 and 22 also has a resonant frequency, and functions as an antenna. Of these, the portion A-B-F of the first antenna element 16 has the higher resonant frequency. As shown in FIG. 8, the antenna is capable of functioning at two resonant frequencies foL and foH. Consequently, the antenna can be used in two frequency bands. Here, it should be clearly apparent that the conductive tongue 16*c* need only be provided on the first antenna element 16 in correspondence with the required resonant frequency band, the base of the second antenna element 22 being conductively connected to the first antenna element 16. Moreover, when the second antenna element 22 is extracted, the portions A-B-C-G, A-B-F, and B-F each function at different resonant frequencies.

The embodiment described above combined the zigzag portion 16*a* extending from the first antenna element 16 in the axial direction, with the folded portion 16*b* extending in the peripheral direction. However, the present invention is not restricted to such a combination, and may acceptably comprise only a zigzag portion and a folded portion extending in the peripheral direction. Moreover, these portions may be coil-shaped, and the antenna may have any type of constitution which enables the conductive tongues 16*c* and 16*c* to be provided at the appropriate positions. Furthermore, the second antenna element 22 may be freely movable in the axial direction, and its external shape may be rod-like, coil-like with a small wind diameter, zigzag-like, etc.

Figure 9C:
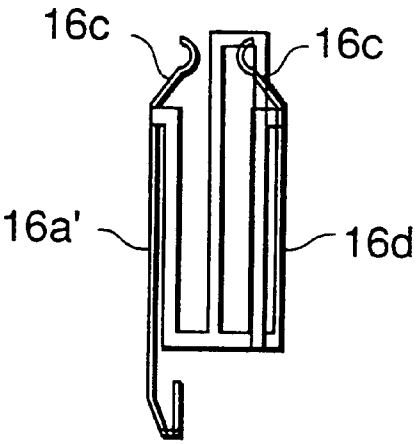
FIGS. 9(*a*) to 9(*c*) respectively show a front view, a side view, and a view of the assembled state of another constitution of the first antenna element.
Figure 9B:
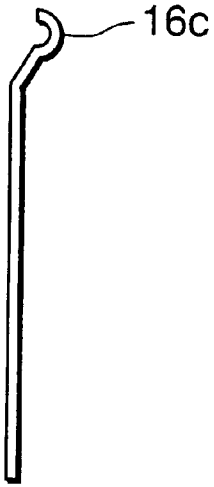
Figure 9A:
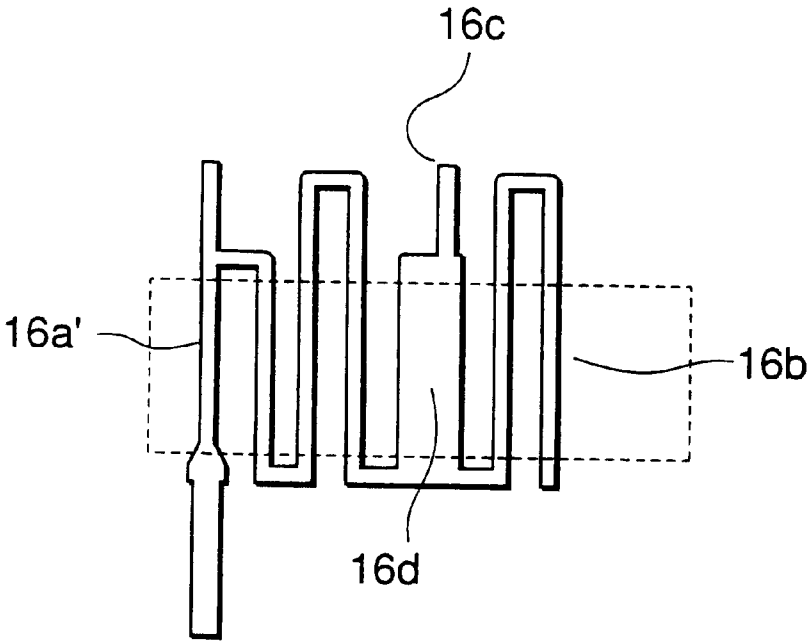

FIG. 9(*a*) shows yet another embodiment, in which the zigzag portion 16*a* of the previous embodiment has been made linear. The embodiments prior to FIG. 8 assumed the use of a relatively low frequency, and the zigzag portion 16*a* was provided in order to increase the length of the antenna element by a certain amount. However, when the frequency is relatively high, a short antenna element is acceptable, and the zigzag portion 16*a* can be made linear. Accordingly, in the embodiments from FIGS. 9(*a*) to 9(*c*) onwards, this portion will be termed linear portion 16*a'*.

Furthermore, FIG. 9(*a*) shows an embodiment wherein the conductive tongue 16*c* in the folded portion 16*b* comprises an impedance adjusting piece 16*d*. In the example shown in FIG. 9(*a*), the impedance adjusting piece 16*d* is provided approximately in the center of the folded portion 16*b*, but it can be positioned closer to, or farther away from, the linear portion 16*a*' after experimental confirmation. Here, the resonant frequency of the portion excluded from between the conductive tongues 16*c* and 16*c* (i.e. the portion to the right of the impedance adjusting piece 16*d* in the folded portion 16*b*) should be distant from the frequency of the radio, thereby ensuring that there would be no hitch in the event that this portion were to resonate.

In FIG. 9(*a*), the impedance adjusting piece 16*d* is rectangular, but its shape is not restricted to a simple rectangular strip, and can be modified by providing a notch-hole, or by making the entire shape round, or the like. However, design conditions require that it is long and thin.

Furthermore, FIG. 9(*b*) is a side view of the conductive tongue 16*c*. A curved portion, shown near the top of the diagram, curves diagonally to form a bend for contact at the top end.

FIG. 9(*c*) shows the linear portion 16*a*' when mounted, that is, it shows the state when the linear portion 16*a*' and the folded portion 16*b* are incorporated. In this case, the two conductive tongues 16*c* and 16*c* are opposite each other, and the groove for clipping 34*a* in the stopper 34 engages therebetween, short-circuiting the two conductive tongues 16*c* and 16*c*.

Figure 10A:
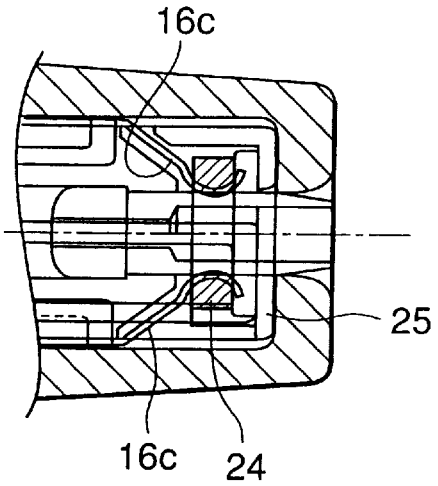
FIGS. 10(*a*) to 10(*c*) respectively show a cross-sectional side view of the state when the ring for clipping 24 is attached to the conductive tongues 16*c* and a spring cover 25 is provided thereon, a plan view of the same, and a partially cross-sectional view taken along the line B—B in FIG. 10(*b*)
Figure 10B:
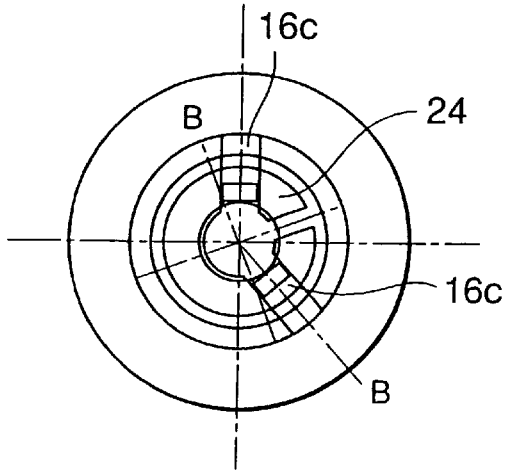
Figure 10C:
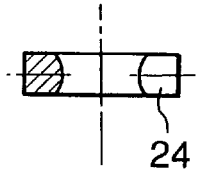

FIGS. 10(*a*), 10(*b*), and 10(*c*) show a C-shaped spring 24 attached to the bends for contact of the conductive tongues 16*c* and 16*c*. The C-shaped spring 24 applies a contact pressure to the bends for contact from the rear thereof. Furthermore, spring covers 25 are provided to protect the conductive tongues 16*c* and 16*c* and the C-shaped spring 24.

As explained in FIGS. 6(*a*) and 6(*b*), the C-shaped spring 24 applies an inward contact pressure to the first antenna element 16. A frequent and occasionally impactive force from the conductive tongues 16*c* and 16*c* acts on the C-shaped spring 24, but the spring covers 25 supply a back-up force. In addition, the spring covers protect the conductive tongues 16*c* and 16*c* and the C-shaped spring 24 from external forces.

Figure 11A:
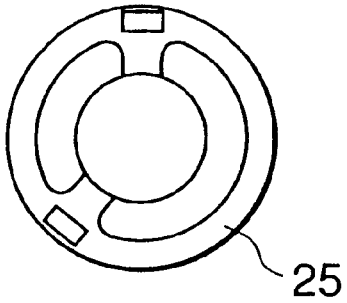
FIGS. 11(*a*) to 11(*c*) respectively show a plan view, a cross-sectional side view, and a side view from a different angle, of the spring cover 25 shown in FIG. 10.
Figure 11B:
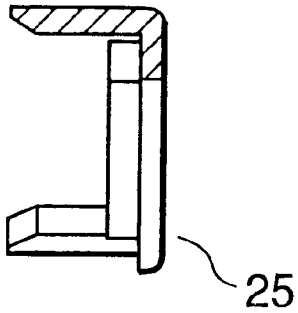
Figure 11C:
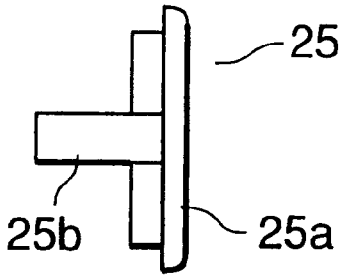

FIGS. 11(*a*), 11(*b*), and 11(*c*) show a constitution of a spring cover 25. As these diagrams show, the spring cover 25 has a ring-shaped portion 25*a*, and two legs 25*b* extending at a right angle from the rim of the ring-shaped portion. Seen from the direction of FIG. 11(*a*), the two legs 25*b* are arranged at an interval of approximately 140 degrees, and the open end of the C-shaped spring is positioned within this range of 140 degrees.

In the embodiment described above, the conductive tongues 16*c* and 16*c* are provided on the inner wall of the ring for clipping 24, and fit into the groove for clipping 34*a* in the stopper 34 of the extracted second antenna element 22, elastically connecting and thereby maintaining a conductive connection. However, the present invention is not restricted to this arrangement, and the constitution may be such that the conductive tongues 16*c* and 16*c* elastically contact the stopper 34 when the antenna is extracted, separately from the ring for clipping 24, which fits into the grooves for clipping 20*a* and 34*a* when the second antenna element 22 is extracted or stored, and remains fitted therein. For example, a conductive spring comprising a folding spring may be provided at the stopper 34 and inserted between the conductive tongues 16*c* and 16*c* so that they do not elastically change their shape, thereby conductively connecting the stopper 34 to the conductive tongues 16*c* and 16*c*. In this constitution, the first antenna element 16 need not elastically change its shape, and may comprise a flexible wire base wound around the core 14, attached in a single body to the mounting metal part 12 by die casting.

Furthermore, in the embodiment described above, the mounting metal part 12 comprises a conductive metal, and the base of the first antenna element 16 is conductively connected thereto by soldering or the like. However, the arrangement is not restricted to this, and the base of the first antenna element 16 may be directly connected as appropriate to an antenna input/output terminal 29*a* of the radio circuit 29 by a cable 28 or the like.

Moreover, the stopper 34 need only be conductively connected to the base of the second antenna element 22, so that the conductive tongues 16*c* and 16*c* elastically contact and conductively connect when the antenna is extracted. Provided that the surface of the groove for clipping 34*a* is a conductor, the structure is not restricted to that of the above embodiment.

Further, it is acceptable to provide three or more conductive tongues, which nonconductively connect when the antenna is stored, and which conductively connect to the base of the second antenna element 22 when the antenna is extracted, and are mutually short-circuited.

Figure 12A:
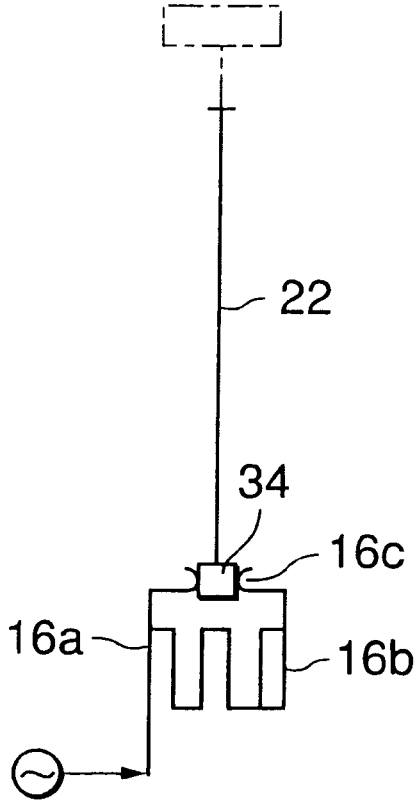
FIGS. 12(*a*) and 12(*b*) illustrate extracted and stored states when the overall length of the antenna is shortened in yet another embodiment.
Figure 12B:
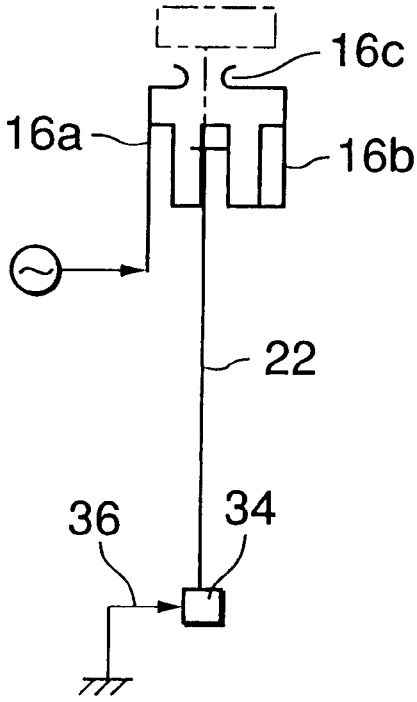

FIGS. 12(*a*) and 12(*b*) show the basic structure of yet another embodiment of the present invention. As shown in FIG. 12(*a*), the rod-like insulating member 20 is considerably shorter than in the first embodiment shown in FIGS. 2(*a*) and 2(*b*). As shown in FIG. 12(*b*), when the second antenna element 22 is stored, its top end as seen in the diagram is in the middle of the first. antenna element 16.

In this constitution, it may generally be envisaged that the first antenna element 16 suffers electrical influences, but experiments have shown that such influence is slight. However, in order to reduce this slight influence, a ground member 36 may be provided so that, when the antenna is stored, the bottom end of the second antenna element 22 as seen in the diagram makes contact with the stopper 34. This grounding means may be an ac ground comprising a capacitor, or a ground connection structure in which a spring member mechanically makes contact with the bottom of the second antenna element 22. In this way, the second antenna element 22 is prevented from functioning when it is stored.

As a result, the length of the antenna is reduced by an amount equivalent to the length of the rod-like insulating member 20, making it possible to provide an antenna suitable for miniturizing a radio device, such as a mobile telephone. Furthermore, in a mobile telephone having a large space for storing an antenna, the length of the second antenna element 22 can be increased by an amount equivalent to the length of the rod-like insulating member 20, making it possible to provide a high-gain antenna.

Figure 13A:
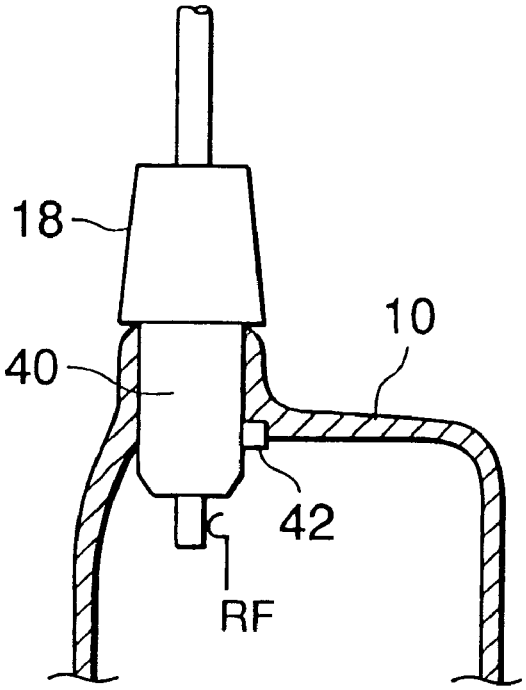
FIGS. 13(*a*) to 13(*c*) are diagrams showing an antenna attached to the case using a sleeve in yet another embodiment, being respectively a partial vertical cross-sectional view of the case, and a view of the bottom face of the sleeve.
Figure 13B:
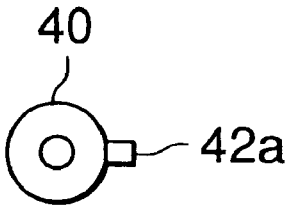
Figure 13C:
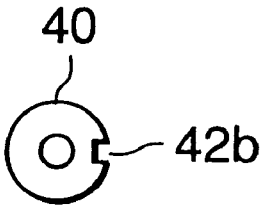

FIGS. 13(*a*) and 13(*b*) show another example of an antenna mounted on a radio device, such as a mobile telephone. In the embodiment shown in FIGS. 2(*a*) and 2(*b*), the antenna is attached by a screw-in metal part 12 to the case 10 of a radio device. By contrast, in FIGS. 13(*a*) and 13(*b*), the base of the antenna comprises a cylindrical sleeve 40 having an outwardly protruding claw near its lower portion as seen in the diagram, and a concavity in the case 10 of the mobile telephone for containing the claw.

Consequently, when the antenna is inserted from above the case 10 into the antenna attachment hole therein, the claw 42 of the sleeve 40 sinks into the sleeve 40 sufficiently far to pass through the antenna attachment hole, but, once through, it sinks so as to fit into the concavity in the case 10. Then, the antenna can be firmly secured in the case parallel to its length and its axis.

The claw 42*a* may be provided on the sleeve 40 as shown in FIG. 13(*a*), and a concavity may be provided in the case 10 as shown in FIG. 13(*b*). Alternatively, the claw may be provided on the case 10, and the concavity 42*b* provided in the sleeve 40.

As explained above, according to the antenna for radio device and the radio device of the present invention, when the antenna is extracted, the first antenna element and the second antenna element are conductively connected and function as a single antenna, thereby maintaining stable antenna characteristics. Consequently, since no adjustment is needed during manufacture, the devices are well-suited to mass production. Furthermore, the two conductive tongues are short-circuited so that a portion of the first antenna element does not function as an antenna, thereby preventing gain decrease caused by unwanted antenna connection and the like.

What is claimed is:

1. An antenna for radio device comprising: a mounting metal part having a through hole therein and being attached to a case of a radio device; a first antenna element provided cylindrically to this mounting metal part around the same axis as said through hole and projecting to the outside of the case; conductive tongues projecting from a plurality of places on the first antenna element; a rod-like second antenna element having a rod-like insulating member at its tip portion, and being capable of moving freely in the axial direction of said through hole and said cylindrical first antenna element; said plurality of conductive tongues conductively connecting to a base portion of said second antenna element and to each other when said second antenna element is extracted, and said plurality of conductive tongues clasping either side of said rod-like insulating member, and connecting nonconductively to each other when said second antenna element is stored.

2. The antenna for radio device according to claim 1, said first antenna element comprising a zigzag portion or a folded portion extending in the axial direction, and a zigzag portion or a folded portion connected at an axial direction tip portion thereof and extending in the peripheral direction of said cylinder.

3. The antenna for radio device according to claim 2, wherein said conductive tongues project from a plurality of places comprising an axial direction tip portion of a zigzag portion or a folded portion extending in said axial direction, and a middle portion of the axial direction tip portion of a zigzag portion or a folded portion extending in said peripheral direction of said cylinder.

4. The antenna for radio device according to claim 2, wherein said conductive tongues project from a plurality of places comprising an axial direction tip portion of a linear portion extending in the axial direction, and a middle portion of a zigzag portion or a folded portion extending in a peripheral direction of said cylinder and connected at the axial direction tip thereof.

5. The antenna for radio device according to claim 1, wherein said first antenna element comprises a linear portion extending in the axial direction, and a zigzag portion or a folded portion extending in a peripheral direction of said cylinder and connected at the axial direction tip thereof.

6. The antenna for radio device according to claim 5, further comprising a ring for clipping which elastically changes its shape in the direction of its diameter and is provided to said conductive tongues, whereby conductive tongues fit into said groove for clipping as a result of the elasticity of the ring for clipping.

7. The antenna for radio device according to claim 1, wherein axis-encircling grooves for clipping are provided in the tip of said rod-like insulating member and the base of said second antenna element, said plurality of conductive tongues elastically changing shape and fitting into said grooves for clipping, and at least the surface of said groove for clipping in the base of said second antenna element comprising a conductor which conductively connects to the base of said second antenna element.

8. The antenna for radio device according to claim 1, wherein said conductive tongues, provided in the middle of said folded portion and said zigzag portion extending cylindrically in the peripheral direction, further comprise an impedance adjusting piece.

9. A radio device using the antenna for radio device of claim 1, wherein said mounting metal part comprises a conductive metal, the base of said first antenna element is secured and conductively connected to said mounting metal piece, and said mounting metal piece is conductively connected to an antenna input/output terminal of a radio circuit.

10. An antenna for radio device comprising: a mounting metal part having a through hole therein and being attached to a case of a radio device; a first antenna element provided to this mounting metal part cylindrically around the same axis as said through hole and projecting to the outside of the case; conductive tongues projecting from the first antenna element; a rod-like second antenna element having a rod-like insulating member at its tip portion, capable of moving freely in the axial direction of said through hole and said cylindrical first antenna element; said plurality of conductive tongues conductively connecting to a base portion of said second antenna element when said second antenna element is extracted, and said conductive tongues clasping either side of said rod-like insulating member when said second antenna element is stored.

* * * * *